US005689987A

United States Patent [19]

Yasui

[11] Patent Number: 5,689,987

[45] Date of Patent: Nov. 25, 1997

[54] METHOD FOR DETERMINING THE PROPER PROGRESS OF A SUPERPLASTIC FORMING PROCESS BY MONITORING GAS-MASS OUTFLOW

[75] Inventor: Ken K. Yasui, Huntington Beach, Calif.

[73] Assignee: McDonnell Douglas Corporation, Hungtington Beach, Calif.

[21] Appl. No.: 721,480

[22] Filed: Sep. 27, 1996

[51] Int. Cl.[6] ..... B21D 26/02

[52] U.S. Cl. ..... 72/60; 72/20.1; 72/342.2; 72/709

[58] Field of Search ..... 72/20.1, 38, 60, 72/342.2, 364, 709

[56] References Cited

U.S. PATENT DOCUMENTS

| | | | |
|---|---|---|---|
| 4,217,397 | 8/1980 | Hayase et al. . | |
| 4,233,831 | 11/1980 | Hamilton et al. | 72/60 |
| 4,708,008 | 11/1987 | Yasui et al. . | |
| 4,901,552 | 2/1990 | Ginty et al. . | |
| 5,129,248 | 7/1992 | Yasui . | |
| 5,309,747 | 5/1994 | Yasui . | |

FOREIGN PATENT DOCUMENTS

| | | | |
|---|---|---|---|
| 3125367 | 1/1983 | Germany | 72/60 |
| 197021 | 8/1989 | Japan | 72/60 |

*Primary Examiner*—David Jones

*Attorney, Agent, or Firm*—Bell, Seltzer, Park & Gibson, P.A.

[57] ABSTRACT

A method and apparatus for determining the progress of a superplastic formation process that uses cumulative gas-mass outflow from a forming part being formed from generally one or more sheets of superplastically formable material, a process that may include selective diffusion bonding of the sheets together. The method includes using the expected initial conditions of the process to determine the gas-mass cumulative exhaust at room temperature and pressure. The method is advantageous over inlet measuring methods where high pressure gas must be measured and any small hole in the system results in large errors.

8 Claims, 7 Drawing Sheets

METHOD FOR DETERMINING THE PROPER PROGRESS OF A SUPERPLASTIC FORMING PROCESS BY MONITORING GAS-MASS OUTFLOW

FIELD OF THE INVENTION

This invention relates to the field of metal forming and, more particularly, to monitoring the formation of a superplastically formable metal sheet into a forming die, with a controlled gas flow where the actual cumulative gas-mass outflow is compared to theoretical cumulative gas-mass outflow to determine if the progress of the process is proceeding properly and when the process is complete.

BACKGROUND OF THE INVENTION

Superplasticity is the characteristic demonstrated by certain metals which exhibit extremely high plasticity. They develop high tensile elongations with minimum necking when deformed within specific temperature ranges and limited strain rate ranges. The methods used to form and in some cases diffusion bond superplastic materials capitalize on these characteristics and typically employ gas pressure to form sheet material into or against a configurational die in order to form the part. Diffusion bonding is frequently associated with the process. U.S. Pat. No. 3,340,101 to D. S. Fields, Jr. et al.; U.S. Pat. No. 4,117,970 to Hamilton et al.; U.S. Pat. No. 4,233,829 to Hamilton et al.; and U.S. Pat. No. 4,217,397 to Hayase et al. are all basic patents, with various degrees of complexity, relating to superplastic forming. All of these references teach processes which attempt to control stress, and thereby strain, by controlling the pressure in the forming process versus time.

Exceptions to controlling forming rates by controlling pressure versus time are taught in U.S. Pat. No. 4,708,008 to Yasui et al. and U.S. Pat. No. 5,129,248 to Yasui. Yasui et al. teaches measuring and controlling the volume displaced by the blank being formed so as to measure total strain or surface area increase of the blank while Yasui teaches an apparatus and method for controlling superplastic forming processes by measuring and controlling the gas mass flow rate of the gas displacing the blank being formed The present invention is an improvement to that shown in U.S. Pat. No. 4,708,008.

U.S. Pat. No. 4,489,579 to Daime et al. also teaches controlling the process by controlling pressure versus time, but also teaches additional devices for monitoring the forming rate by providing a tube which penetrates the die and engages a portion of the blank to be formed. As the blank is formed, the tube advances through the die directly as that portion of the blank is formed. Means are also provided to produce a signal at predetermined amounts of advancement of the tube and further, electrical contacts are provided at recess angles of the die and the switch is closed when the blank being formed, it provides for monitoring the forming step which allows the operator to evaluate the development process of the part. However, it is not very practical to have a sliding tube probe with the associated geometric disturbance at the contact point, nor is it practical to provide electrical instrumentation in the harsh environment where superplastic forming must take place.

Excessive strain rates cause rupture and must be avoided in the forming process. In order to understand excessive strain rates it is necessary to understand the relationship between the variables in superplastic forming which are represented by the classic equation $$\sigma = K\dot{\epsilon}^m$$

where m is the strain rate sensitivity, $\sigma$ is stress, $\dot{\epsilon}$ is strain rate, and K is a constant.

In the absence of strain hardening, the higher the value of m, the higher the tensile elongation. Solving the classic equation for m, $$m = \frac{\ln\sigma - \ln K}{\ln\dot{\epsilon}}$$

In addition to strain rate, the value of m is also a function of temperature and microstructure of the material. The uniformity of the thinning under biaxial stress conditions also correlates with the value of m. For maximum deformation stability, superplastic forming is optimally performed at or near the strain rate that produces the maximum allowable strain rate sensitivity. However, because the strain rate sensitivity, m, varies with stress as well as temperature and microstructure, m constantly varies during a forming process.

Furthermore, the strain rate varies at different instances of time on different portions of the formation inasmuch as stress levels are non-uniform. The more complex the part, the more variation there is, and, therefore, strain rate differs over the various elements of the formation. Since strain rate, stress, temperature and microstructure are all interdependent and varying during the process, the relationship is theoretical. As a practical matter, there is no predictable relationship that can be controlled so as to form all portions of complex parts at the optimum strain rate sensitivity and therefore the optimum strain rates. However, the artisan can plot strain rate sensitivity (m) against strain rate ($\dot{\epsilon}$) and stress ($\sigma$) against strain rate ($\dot{\epsilon}$) and establish the best compromise ranges to be caused as guides. Prior to Yasui, those skilled in the art had to select and control those portions of the formation, which are more critical to successful forming while maintaining all other portions at the best or less than the best strain rates which necessary becomes the overall optimum rate.

This was further complicated for deep forming, which requires forming pressure reduction due to the higher thinning rate of the material, if during the forgoing process, the blank was not be exactly where it is thought to be at any given time in the forming process.

By controlling the process with either pressure or perhaps volume alone, only one of the variables in Boyle's Law $$\frac{P_1 \times V_1}{T_1} = \frac{P_2 \times V_2}{T_2}$$

(where P, V, and T represent pressure, volume, and temperature, respectively) was used to control the process. Yasui found that the process was much more stable when instead of controlling pressure which was the accepted practice at the time, the mass of gas used to form was controlled. The stability of this process is due to the recognition that if a controlled mass rate is introduced, when the forming blank is being strained too slowly, the pressure will build up until the applied stress increases to increase the strain rate. When the blank is forming too fast, the pressure drops or at least its rate of increase diminishes to slow down the strain rate due to volume increase. However there has been a need to monitor superplastic sheet forming for early detection of departure from the desired process, so that corrections can be made before the forming sheet is ruined and to determine when the end of the process has been successfully reached. Preferably, this would be accomplished in a relatively benign environment at room temperature and pressure.

SUMMARY OF THE INVENTION

This invention teaches monitoring a superplastic forming process by measuring the gas-mass exhaust flow from the forming die caused by formation of the sheet into the die, and plotting the total cumulative exhaust gas-mass flow, when the gas-mass flow of the forming gas is controlled as described by Yasui in U.S. Pat. No. 5,129,248. A chart or data base is prepared using initial conditions of die volume, ambient (room) temperature, gas constant, and atmospheric pressure to develop a plot of cumulative exhaust gas-mass versus forming pressure. The exhaust from the process is cooled to room temperature and the forming pressure, and exhaust gas-mass flow at atmospheric pressure and temperature are measured with the cumulative exhaust gas-mass accumulation being continuously determined. The plot of forming pressure and cumulative exhaust gas-mass flow is used to determine that critical steps have occurred in the process at correct times and pressures. The plotting of the forming pressures and cumulative exhaust gas-mass flow can be done automatically on a CRT for observation without manual intervention. The total cumulative gas-mass volume of the die can be calculated in advance by knowing the die volume and the temperature of the die, and presumably the temperature of the gas within the die at the time the present process is started.

From a monitoring standpoint, is is desirable that the present process be started just after a die at room temperature has been load with a sheet to be formed. This rarely occurs in a production environment where it is desirable to only cool a die enough that a formed sheet can be removed therefrom without distortion or excessive oxidation. Therefore, the present process is normally started after a sheet to be formed has been loaded in a hot die and the die has been purged with inert gas, which quickly heats to die temperature. As the inert gas heats, it expands and is allowed to remain at near atmospheric pressure by escaping through a water bubbler, which prevents back flow of oxygen into the die. The mass-gas flow meter is up stream from the bubbler connected to the die by an exhaust tube normally long enough that gas flowing therethrough reaches room temperature before it is measured. In some instances with high flow rates, this may not be the case and the exhaust gas is passed through one or more simple conductive tube-in-water heat exchangers upstream of the flow meter to assure that the exhaust gas is at room temperature before its flow rate is measured. The present monitoring process is advantageous over cumulative gas-mass flow monitoring of the forming gas when sheets are being deformed out against a die surface because the exhaust gas-mass flow is being measured at about ambient pressure where no leaks are likely to exist that would give a false reading.

It therefore is an object of the present invention to provide a method for monitoring superplastic forming processes measuring cumulative exhaust gas-mass flow, especially in those forming processes where only one or two sheets are being formed outwardly against a die surface.

Another object of this invention to provide information as to the health of a superplastic forming process without requiring invasive probes and electrical contacts.

Another object is to provide a method for monitoring superplastic forming processes that measure the critical parameter at room temperature and pressure.

Another object is to provide an improvement to superplastic forming processes that requires no special tools, it being useful with conventional forming tools.

These and other objects and advantages of the present invention will become apparent to those skilled in the art after considering the following detailed specification, together with the accompanying drawings wherein:

DETAILED DESCRIPTION OF THE INVENTION

Figure 1:
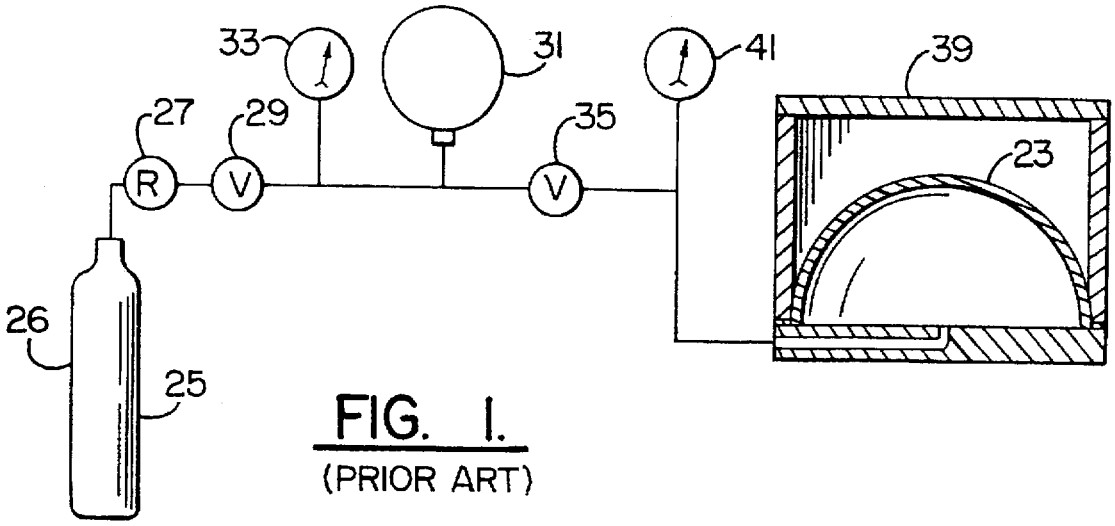
FIG. 1. (PRIOR ART)
FIG. 1 schematically shows the prior art Yasui forming apparatus and the associated accumulator type controller devices.

FIG. 1 is a schematic of a simple prior art apparatus, which is used to control the mass flow of the inert gas used in superplastically forming a single sheet 23. The source 25 of the gas, usually an argon gas bottle 26, is fed through a pressure regulator 27 followed by a shut-off valve 29. When the shutoff valve 29 is open, the inert gas is fed to an accumulator 31, which is sized according to the cavity volume of the part to be formed. A pressure gage 33 is used to read the pressure in the accumulator 31. The smaller the accumulator volume, the more precisely the accumulator pressure can be controlled.

A throttling valve 35 is used to control the gas flow from the accumulator 31 through the base 37 of configurational die 39, which in this example is a simple cylindrical die against the sheet 23. The forming pressure is indicated on the pressure gage 41 downstream of the valve 35. The accumulator 31 is initially pressurized to a predetermined pressure by opening valve 29 and having the pressure regulator set at a predetermined controlling pressure. Once the accumulator 31 is charged to the predetermined pressure at a known temperature and volume, the mass of the gas in the accumulator 31 is readily calculated. The valve 29 is closed and the gas in accumulator 31 is introduced through the valve 35 into the die 39 at a predetermined rate until the pressure falls to a precalcuated minimum pressure, thereby controlling the gas-mass flow in predetermined amounts in short intervals with minimal pressure change. When the accumulator pressure drops to the predicted level, valve 35 is closed and valve 29 is opened to re-charge the accumulator 13 to the predetermined pressure and thereby a predetermined mass. The procedure is then repeated as many times as is required to assure full formation of the sheet 23 into the cylindrical configuration of the die 39.

Figure 2:
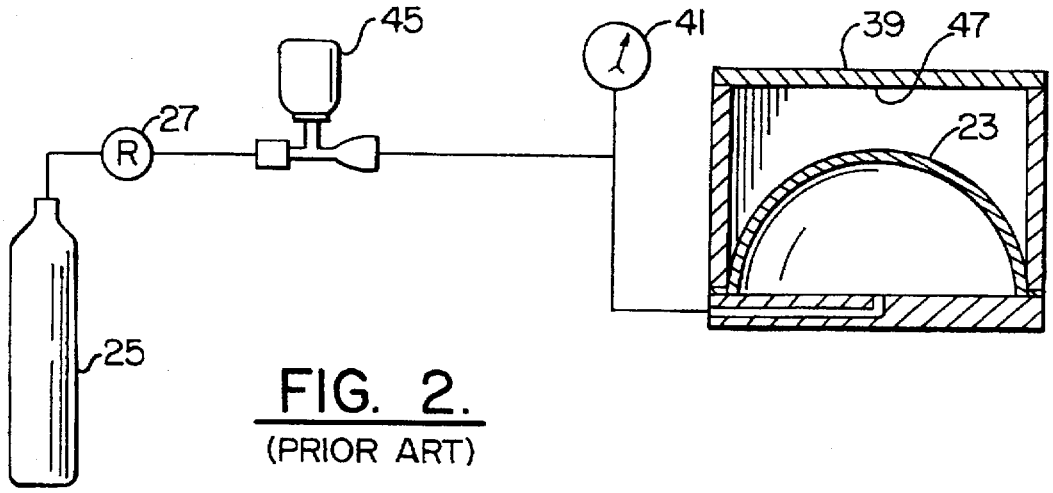
FIG. 2. (PRIOR ART)
FIG. 2 is an alternate controlling device using a gas mass flow meter.

As shown in FIG. 2, a mass flow controller 45 may replace the accumulator 31, the shut-off valve 29, and throttling valve 35 so that the process can be controlled directly from the regulator 27. Suitable mass flow controllers for this purpose are commercially available. The specific model required is determined by the mass flow range required to form a specific specimen. A more sophisticated system may be provided with a neural net program running in a personal computer and an electrically controlled mass flow controller.

Heretofore, no matter what method was used to control the pressure of the forming gas, initial analytical steps were required. The relationship between stress, $\sigma$, and strain rate, $\dot{\epsilon}$, at the forming temperature for any given material had be established either analytically or experimentally. Using this data total deformation of the part being formed was approximated by analyzing the geometry of the particular part being formed as a function of applied stress. Unquestionably, a very accurate stress versus time curve can usually be established computationally for even very complex structures. However, these analyses are very time consuming in light of the many variables and is subject to deviations in the material and process parameters. The substantial benefit of gas mass flow control as compared to pressure control was realized in the minimum amount of analysis required.

Figure 3A:
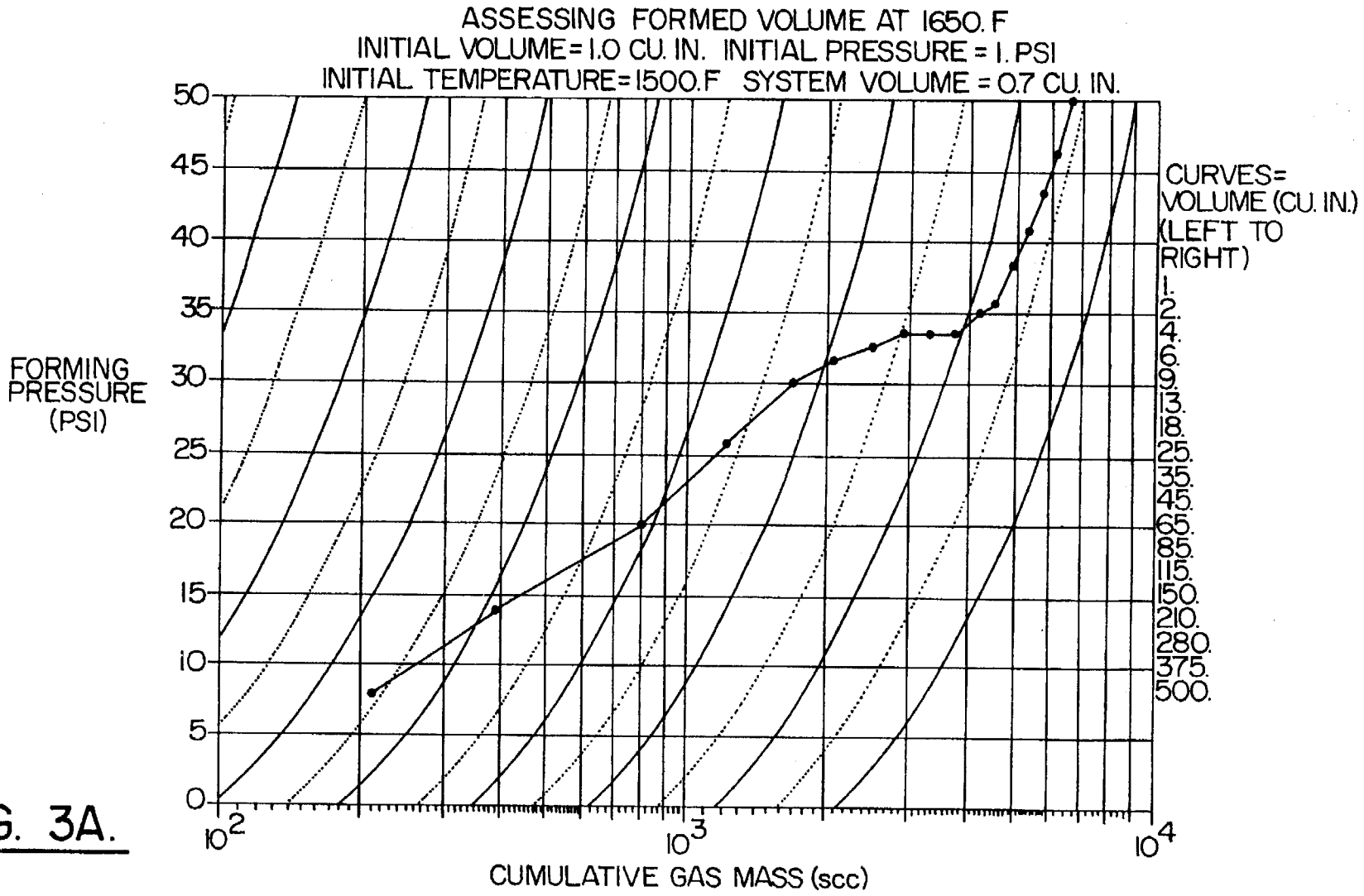
FIG. 3A is a chart or data base of constant volume curves on a graph of forming pressure versus a logarithmic scale of cumulative gas-mass with a typical forming plot for a cylindrically shaped part.

The pre-analysis is practically eliminated by generating a chart or data base of constant volume curves on a plot of forming pressure versus a logarithmic scale of cumulative gas-mass as shown in FIG. 3A. The chart is an expression of the general gas law $$pv=mRT$$

where m is the mass of gas at absolute temperature, T, and R is a constant that depends on the units. The chart of FIG. 3A is easily calculated with a simple program and a desktop computer from inputs of initial volume, pressure, temperature and process system volume, and final maximum forming volume and forming temperature. In the case of FIG. 3A, the initial volume of the part is 1.0 $in^3$, initial pressure is 1.0 psi, initial temperature is 1500° F. and the system for providing the gas has a volume of 0.7 $in^3$. The volume of the die was four hundred seventy $in^3$ while the final volume of the part was about three hundred sixty $in^3$. The difference is due to the volume of the part material and because the test part was not fully formed into the mold, allowing the removal of the part with less effort.

Figure 3B:
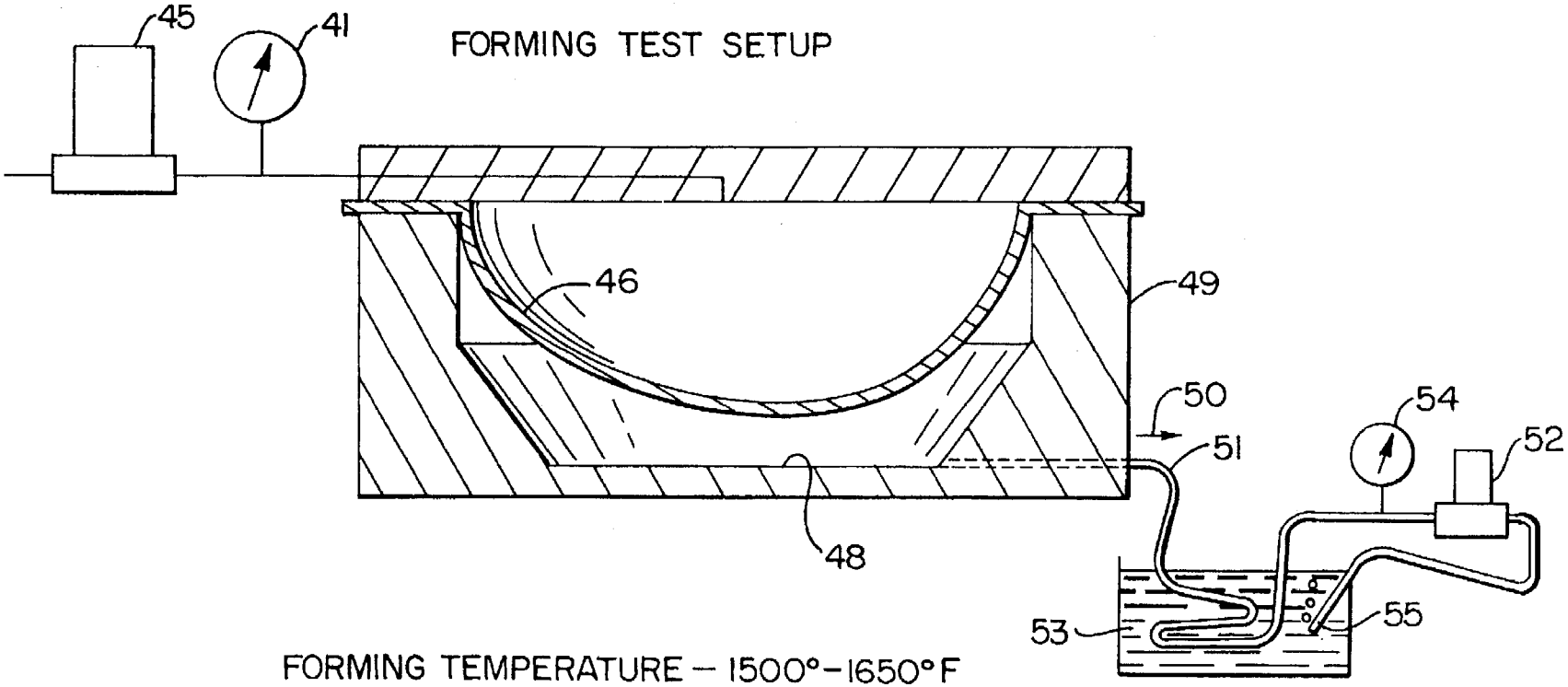
FIG. 3B is a cross-sectional view through a die and a single sheet part as the part is being formed, for the process documented by the plot of FIG. 3A, the view also including the exhaust conditioning and measuring apparatus.

The pressure and cumulative gas-mass is then plotted either manually or automatically and the resultant curve is compared to the ideal constant volume curves. The expected final volume of a part is usually easily calculated, especially if computer designed. In FIG. 3A, for a single sheet part 46 shown in formation in FIG. 3B, the rise in pressure increase rate starting at about 800 scc is due to increasing stress before the desired forming temperature of 1650° F. was reached. At about 1700 scc, the temperature became high enough that the pressure rate increase began to decrease until the substantial contact of the sheet 47 to the bottom surface 48 of the die 49 occurred, which can be seen by the change of slope at about 3800 scc. The part would have reached its fully formed shape at about 100 psi where the plot would have paralleled the three hundred seventy five $in^3$ line at about four hundred and fifty $in^3$.

The progress of the formation of the part 46 is monitored by measuring the exhaust flow 50 out of the die 49. The initial conditions are ambient temperature and pressure since usually the die 49 is purged with room temperature argon before the forming starts. The purging with inert argon prevents unwanted surface reactions at forming and diffusion bonding temperatures. The exhaust is usually small volume that cool to ambient in the line 51 to the gas-mass flow meter 52. However, the line 51 may be run through a water bath 53, as shown, to assure proper cool down during rapid volume expansions of the part 46. A pressure gage 54 may be included to accurately determine that the exhaust is at ambient pressure. The outflow from the flow meter 52, usually is dumped at a nozzle 55 immersed in water to assure that oxygen is not sucked into the die 52 and to provide a visual indication of the volume.

Figure 4:
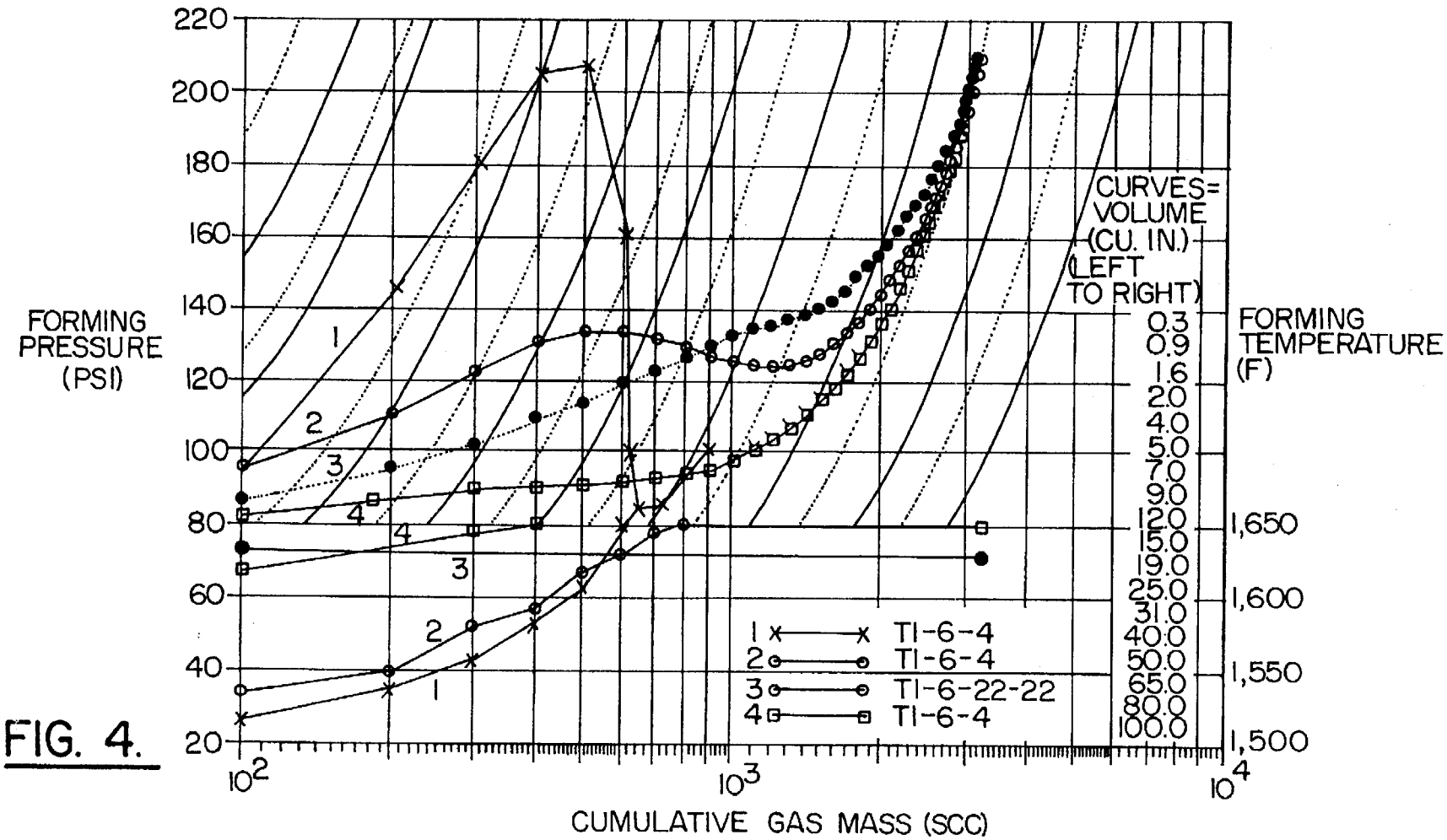
FIG. 4 is a chart similar to FIG. 3A for a four sheet part formed at four different conditions.
Figure 5A:
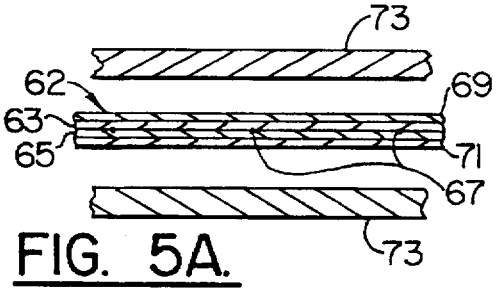
FIGS. 5A, 5B, 5C, and 5D are cross-sectional views of the four sheet part whose curves are in FIG. 4.
Figure 5B:
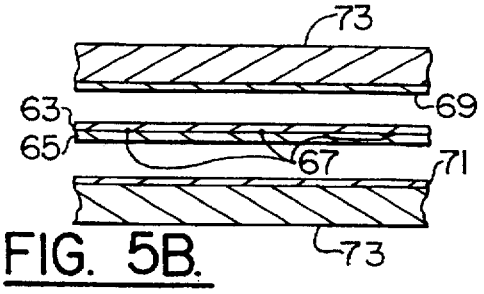
Figure 5C:
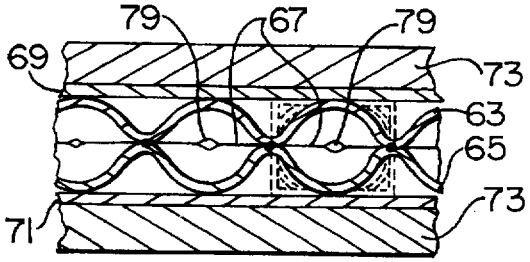
Figure 5D:
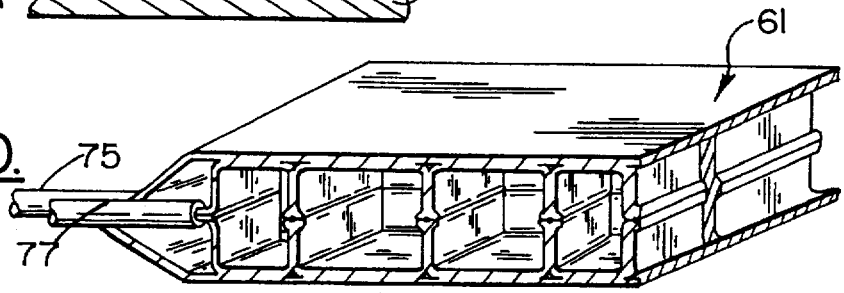

In FIG. 4, which also plots forming temperature against cumulative gas-mass, four different process runs with the same forming die, fabricating a four sheet SPF/DB part 61, such as shown being formed in FIGS. 5A, 5B, 5C, and 5D, are documented. The part 61 starts as a blank 62 including a pair of core sheets 63 and 65 connected together by a cross hatch of interrupted weld beads 67 positioned between two face sheets 69 and 71 in a hot die 73. The face sheets 69 and 71 are expanded against the die 73 by pressure introduced through tube 75 until they expand against the die 73 (FIG. 5B). Thereafter the gas-mass forming commences with inert gas being introduced through tube 77 so that the core sheets 63 and 65 expand (FIG. 5C) out against the face sheets 69 and 71. The resultant part 61 before the pressure tubes have been removed is shown in FIG. 5D.

In run 1, the temperature of formation was low for the early time of the formation process and passages 79 within the part blank 62 to distribute the gas from tube 77 apparently were obstructed. Note how the pressure reached over 200 psi and yet the part was clearly not formed because only about five hundred standard cubic centimeters (scc), which are units of mass, of inert gas had been introduced. As a corrective measure, the gas-mass flow was stopped for about five minutes while the temperature was elevated. When the temperature was elevated to over 1600° F., the internal passages 79 became unobstructed and the pressure dropped back to the expected pressure. Gas-mass flow was resumed when the pressure decreased sufficiently and thereafter run 1 duplicated run 4, where the temperature was close to 1650° F. from the start of the formation process and the passages 79 were properly open from the start. Note how temperature sensitive the process can be from run 2 where a much, lower pressure spike occurred when forming was started during heat up but at a slightly higher temperature. Run 3 was titanium alloy Ti-6-22-22 instead of Ti-5-4 and occurred at a constant temperature of 1630° F., so the formation pressures are generally higher, but controlled. As the final volume of the part 61 was reached (about 52 $cc^3$) all of the plots of the runs became asymptotic to the family of constant volume curves, indicating that no further formation was occurring. Thus, the plot provides an indication of the health of the process as it proceeds, of various transition points during the process, and of normal completion without requiring extensive calculations as were previously required. For production purposes, the monitoring process can be converted into a graph of time versus percentage completion once the proper process parameters have been set. The production personnel then look to see that the part is forming at the proper rate against the clock, and take corrective action only if the part is forming too fast or too slow.

Figure 6:
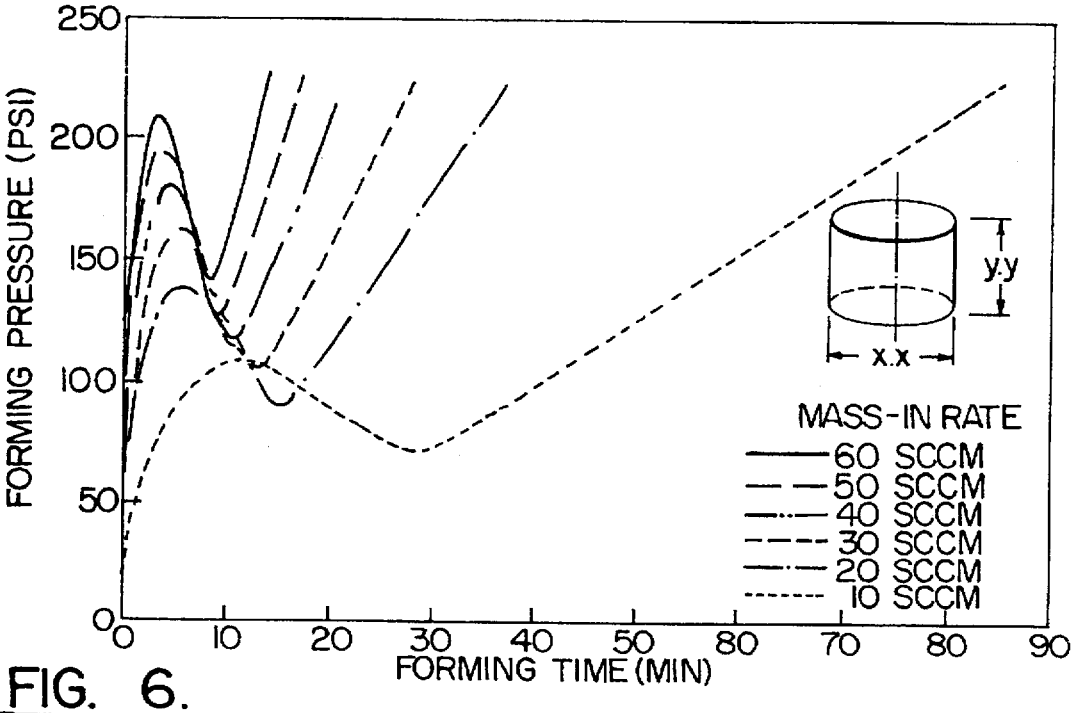
FIG. 6 shows a graph of characteristic pressure curves for the part of FIGS. 1 and 2 formed at different gas-mass flow rates.

FIG. 6 is a graph of characteristic pressure curves for the part of FIGS. 1 and 2 formed at different gas-mass flow rates. Note how the maximum pressure increases with increasing flow rate and of course how the length of the process is reduced by faster flow rates. These characteristic curves can also be used by production personnel to monitor the production process.

Figure 7:
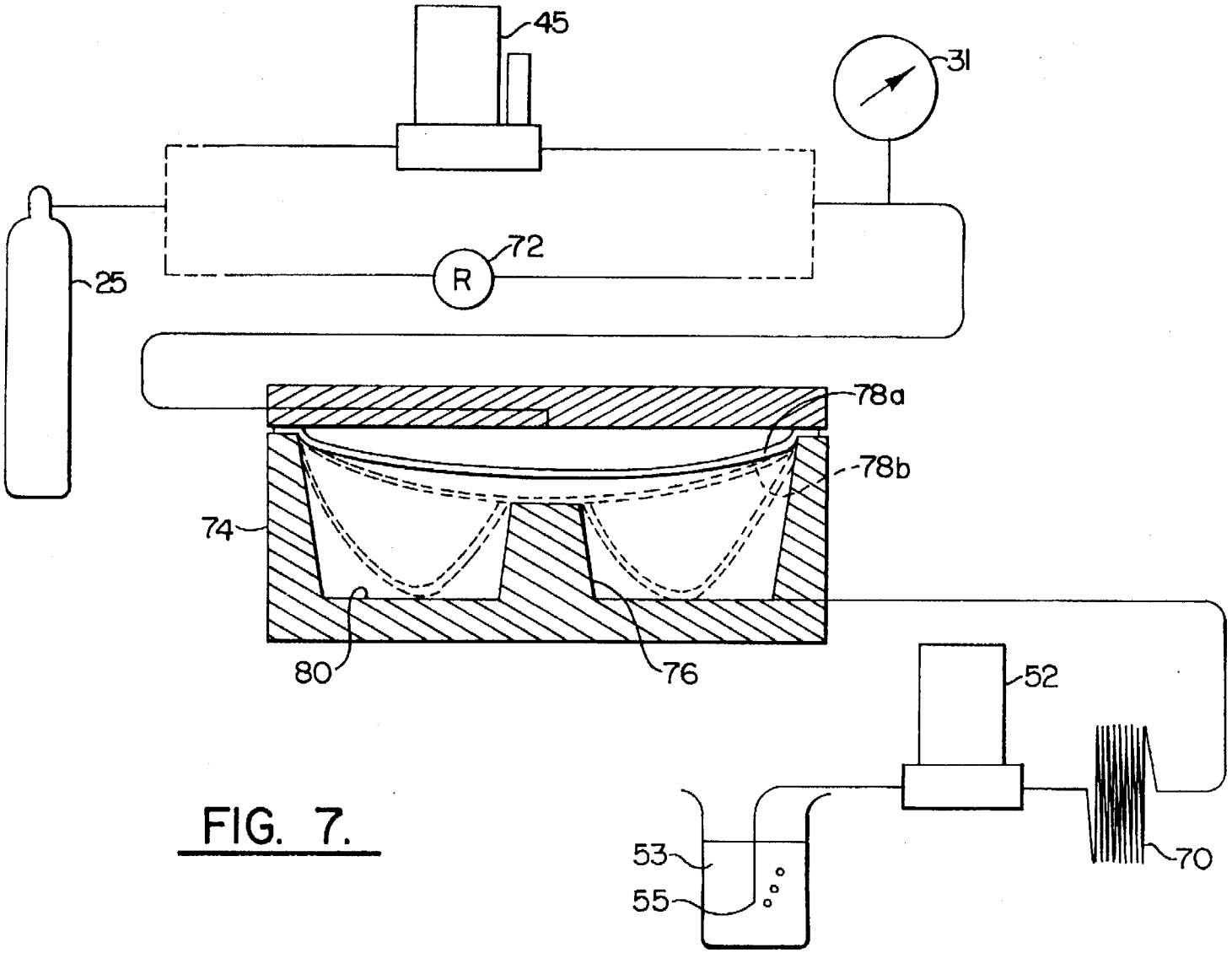
FIG. 7 is a cross-sectional view through a more complex die than in FIG. 3B showing the various stages of the part as it is being formed.
Figure 8:
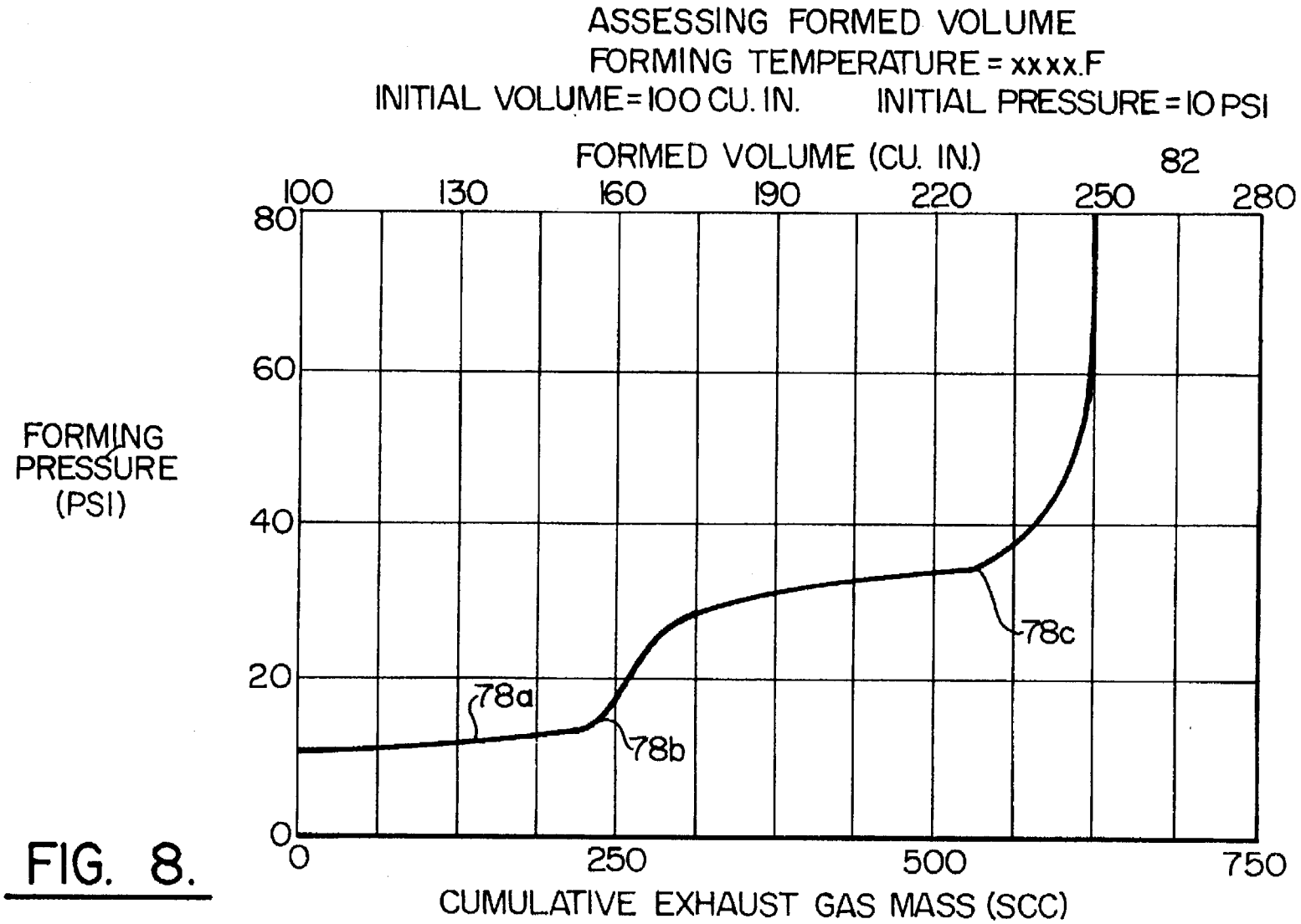
FIG. 8 is a graph of inlet pressure versus cumulative gas-mass exhaust showing various points in the superplastic forming process for the die of FIG. 7.

The modified apparatus of FIG. 7 includes a heat exchanger 70 instead of a water bath and an optional pressure regulator 72 on the inlet side. The die 74 has a protrusion 76 that engages the forming part 78 first, the part 78 being shown in three points during its forming progress 78*a* where it is expanding in a single curve, 78*b* as it touches the protrusion 76 and 78*c* where it touches the base 80 of the die 74. FIG. 8 is a graph of inlet pressure versus cumulative gas-mass exhaust at how the transitions in the process can be seen by reference to the graph. The process is complete at point 82 where the curve goes essentially vertical.

Thus, there has been shown novel SPF/DB monitoring methods which fulfill all of the objects and advantages sought therefor. Many changes, alterations, modifications and other uses and applications of the subject invention will become apparent to those skilled in the art after considering the specification together with the accompanying drawings. All such changes, alterations and modifications which do not depart from the spirit and scope of the invention are deemed to be covered by the invention which is limited only by the claims that follow.

I claim:

1. A method for monitoring a superplastic forming process in forming equipment that introduces forming gas to deform a sheet of superplastically formable material into a forming die including:

determining the initial volume of the forming die into which the sheet is to be formed;

determining the temperature of the gas within the forming die at which exhaust gas-mass flow measuring equipment is going to start measuring the exhaust gas flow from the forming die;

determining the ambient pressure and temperature;

calculating the cumulative gas-mass that should be exhausted from the forming die from the initial conditions of temperature of the gas within the forming die, the ambient temperature and ambient pressure using the formula $v=mRT/p$ where m is the mass of gas at absolute temperature, T, p is pressure and R is a constant that depends on the units used;

measuring the cumulative exhaust gas-mass that exhausts from the forming die, said measuring being at ambient temperature and pressure; and comparing the actual cumulative exhaust gas-mass of the process against the calculated cumulative exhaust gas-mass to determine when the sheet has formed into the forming die.

2. The method as defined in claim 1 wherein the comparing of the actual cumulative exhaust gas-mass of the process against the calculated cumulative exhaust gas-mass includes:

plotting the cumulative exhaust gas-mass against forming pressure.

3. The method as defined in claim 2 including:

comparing slope of the curve of the actual pressure/cumulative gas-mass exhaust to vertical to determine when the process is finished.

4. The method as defined in claim 1 including:

cooling the gas exhaust to ambient temperature before measuring it.

5. A method for monitoring a superplastic forming process in forming equipment that introduces .forming gas at a controlled gas-mass rate to deform a blank into one or more dies including:

determining the initial volume of the one or more forming die into which the blank is to be formed;

determining the temperature of the gas within the one or more forming dies at which exhaust gas-mass flow measuring equipment is going to start measuring the exhaust gas flow from the one or more forming dies;

determining the ambient pressure and temperature;

calculating the cumulative gas-mass that should be exhausted from the one or more forming dies from the initial conditions of temperature of the gas within the forming die, the ambient temperature and ambient pressure using the formula $v=mRT/p$ where m is the mass of gas at absolute temperature, T, p is pressure and R is a constant that depends on the units used;

measuring the cumulative exhaust gas-mass that exhausts from the one or more forming dies at ambient temperature and pressure; and comparing the actual cumulative exhaust gas-mass of the process against the calculated cumulative exhaust gas-mass to determine when the sheet has formed into the one or more forming dies.

6. An apparatus to control a superplastic forming process in a forming die including:

a gas connection to the inlet side of the forming die;

a gas connection to the exhaust side of the forming die;

means to assure the exhaust gas is at ambient temperature connected to said gas connection to the exhaust side of the forming die;

a pressure gage connected to said gas connection to the inlet side of the forming die;

a gas-mass flowmeter connected to said means to assure the exhaust gas is at ambient temperature for measuring the exhaust gas at ambient temperature.

7. The apparatus to control a superplastic forming process in a forming die as defined in claim 6 including:

a water bath;

a connection from said gas-mass flow meter to exhaust in said water bath.

8. The apparatus to control a superplastic forming process in a forming die as defined in claim 7 wherein said means to assure the exhaust gas is at ambient temperature include:

a passageway in heat communication with said water bath.

* * * * *

UNITED STATES PATENT AND TRADEMARK OFFICE
CERTIFICATE OF CORRECTION

PATENT NO. : 5,689,987

DATED : Nov. 25, 1997

INVENTOR(S) : Yasui

It is certified that error appears in the above-identified patent and that said Letters Patent is hereby corrected as shown below:

Column 6, line 54, "Ti-5-4" should be --Ti-6-4--.

Column 8, line 11, after "introduces" omit the period (.).

Signed and Sealed this

Twenty-first Day of April, 1998

Bruce Lehman

*Attest:*

BRUCE LEHMAN

*Attesting Officer*

*Commissioner of Patents and Trademarks*